US007898787B2

(12) United States Patent
Johnsen et al.

(10) Patent No.: US 7,898,787 B2
(45) Date of Patent: Mar. 1, 2011

(54) POWER PANEL WITH ANGLED CONNECTORS

(75) Inventors: David J. Johnsen, Plymouth, MN (US); Joseph C. Coffey, Burnsville, MN (US); Duane R. Sand, Annandale, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 12/575,572

(22) Filed: Oct. 8, 2009

(65) Prior Publication Data

US 2010/0120286 A1 May 13, 2010

Related U.S. Application Data

(60) Provisional application No. 61/104,165, filed on Oct. 9, 2008.

(51) Int. Cl.
*H01C 7/12* (2006.01)

(52) U.S. Cl. ..... 361/119

(58) Field of Classification Search ..... 439/540.1; 361/119, 824, 825
See application file for complete search history.

(56) References Cited

U.S. PATENT DOCUMENTS

| | | | | |
|---|---|---|---|---|
| 4,131,147 | A * | 12/1978 | Schrage | 206/316.2 |
| 6,035,032 | A * | 3/2000 | Daoud | 379/326 |
| 6,456,203 | B1 | 9/2002 | Schomaker et al. | |
| 6,806,420 | B2 | 10/2004 | Schomaker et al. | |
| 6,873,510 | B2 | 3/2005 | Schomaker et al. | |
| 6,905,372 | B2 | 6/2005 | Cabrera et al. | |
| 7,005,996 | B2 | 2/2006 | Cabrera et al. | |
| 7,126,803 | B2 | 10/2006 | Schomaker et al. | |
| 7,144,280 | B2 | 12/2006 | Cabrera et al. | |
| 7,304,834 | B2 | 12/2007 | Schomaker et al. | |
| 7,440,262 | B2 | 10/2008 | Coffey et al. | |
| 7,458,860 | B2 | 12/2008 | Cabrera et al. | |
| 7,460,360 | B2 | 12/2008 | Schomaker et al. | |
| 7,585,034 | B2 | 9/2009 | Cabrera et al. | |
| 2007/0298652 | A1 * | 12/2007 | Clark et al. | 439/540.1 |
| 2009/0141431 | A1 | 6/2009 | Schomaker et al. | |
| 2009/0154070 | A1 | 6/2009 | Coffey et al. | |

OTHER PUBLICATIONS

Photographs of Telect Power Distribution Panel, 7 Pages, publicly available at least as of Oct. 9, 2008.
Photographs of Cisco Power Distribution Panel (Cisco 15454-FAP-LVD), 4 Pages, publicly available at least as of Oct. 9, 2008.

(Continued)

*Primary Examiner* — Phuong K Dinh
(74) *Attorney, Agent, or Firm* — Merchant & Gould P.C.

(57) ABSTRACT

A power distribution panel is disclosed. The power distribution panel includes a panel enclosure having a front face, a rear face, and an interior. The panel also includes a first plurality of connection blocks, each of the first plurality of connection blocks located on the rear face of the panel enclosure and oriented at a first common angle relative to the front face of the panel enclosure. The panel further includes a second plurality of connection blocks, each of the second plurality of connection blocks located on the rear face of the panel enclosure and oriented at a second common angle relative to the rear face of the panel enclosure. The panel includes a plurality of circuit protection modules located on the front face of the panel enclosure, and a plurality of conductive bars passing through the enclosure and connecting the input connection blocks to one of the plurality of circuit protection modules, each of the conductive bars including a generally straight portion passing from the rear of the panel to the front of the panel.

21 Claims, 9 Drawing Sheets

OTHER PUBLICATIONS

User Manual for Cisco Power Distribution Panel (Cisco ONS 15454-FAP-LVD Operations Guide, Release 2.0), 78 Pages, Jan. 2004.

Installation Drawings for ADC Power Panel (ADC PWX-001RGSSD10PSEP), 2 Pages, publicly available at least as of Oct. 9, 2008.

Panel Photographs ADC Power Panel (ADC PWX-001RGSSD10PSEP), 6 Pages, publicly available at least as of Oct. 9, 2008.

* cited by examiner

POWER PANEL WITH ANGLED CONNECTORS

CROSS REFERENCE TO RELATED APPLICATION

This application claims priority to U.S. Provisional Patent Application Ser. No. 61/104,165, filed Oct. 9, 2008, the disclosure of which is hereby incorporated by reference in its entirety.

TECHNICAL FIELD

The present disclosure relates generally to power distribution systems. In particular, the present disclosure relates to a power panel with angled connectors.

BACKGROUND

Electrical circuit panels such as power distribution panels typically include a number of different circuit elements such as fuse holders and fuses, circuit breakers, input and output connectors and alarm signal LED's. For safety and other reasons, the electrical circuits of power distribution panels are enclosed within a housing structure. Therefore, the circuit elements listed above have typically been inserted into holes that have been formed in the housing structure, usually on a front or back panel of the housing structure.

Existing electrical circuit panels include connection blocks arranged on one side of the panel, with circuit protection elements arranged on an opposite side of the panel. In such arrangements, the connection blocks are connected to the circuit protection elements by wiring passing through the panel. The connection blocks are typically positioned flush with the front or back panel of the circuit panel, and receive connections of load or supply wires to be mounted to posts of input and output connections. Additional alarm circuitry or other circuit elements are included within the circuit panel, according to the specific operation of the panel.

This panel design has a variety of disadvantages. For example, when servicing the panel, it can be difficult to reach the circuitry among the intertwined cabling passing through the panel and connecting the connection blocks to the circuit protection elements. Additionally, when connecting a number of power supply cables or load cables to the connection blocks, it can be difficult to route the cables to the panel due to the linear arrangement and the required density of the connection blocks.

For these and other reasons, improvements to existing electrical circuit panels are desirable.

SUMMARY

In accordance with the following disclosure, the above and other problems are solved by the following:

In a first aspect, a power distribution panel is disclosed. The power distribution panel includes a panel enclosure having a front face, a rear face, and an interior. The panel also includes a first plurality of connection blocks, each of the first plurality of connection blocks located on the rear face of the panel enclosure and oriented at a first common angle relative to the rear face of the panel enclosure. The panel further includes a second plurality of connection blocks, each of the second plurality of connection blocks located on the rear face of the panel enclosure and oriented at a second common angle relative to the rear face of the panel enclosure. The panel includes a plurality of circuit protection modules located on the front face of the panel enclosure, and a plurality of conductive bars passing through the enclosure and connecting the input connection blocks to one of the plurality of circuit protection modules, each of the conductive bars including a generally straight portion passing from the front of the panel to the rear of the panel.

In a second aspect, a power distribution panel is disclosed. The power distribution panel includes a panel enclosure having a front face, a rear face, and an interior. The power distribution panel also includes a first plurality of connection blocks, each of the first plurality of connection blocks located on the rear face of the panel enclosure and having input and output connections oriented at a first common angle relative to the rear face of the panel enclosure, and a second plurality of connection blocks, each of the second plurality of connection blocks located on the rear face of the panel enclosure and having input and output connections oriented at a second common angle relative to the rear face of the panel enclosure. The power distribution panel further includes a plurality of circuit protection modules located on the front face of the panel enclosure, each of the circuit protection modules associated with one of the first or second plurality of connection blocks. The power distribution panel includes a plurality of conductive bars passing through the enclosure and connecting the input connection blocks to the associated one of the plurality of circuit protection modules, each of the conductive bars including a straight portion passing from the front of the panel to the rear of the panel and connecting between one of the plurality of circuit protection modules and one of the first and second pluralities of connection blocks.

In a third aspect, a method of assembling a power distribution panel is disclosed. The method includes attaching a first plurality of connection blocks to a rear face of a panel enclosure at a first plurality of angled mounting locations having a first common angle relative to the rear face of the panel enclosure, and attaching a second plurality of connection blocks to the rear face of the panel enclosure at a first plurality of angled mounting locations having a second common angle relative to the rear face of the panel enclosure. The method further includes locating a plurality of circuit protection modules at the front face of the panel enclosure, and connecting the first and second pluralities of connection blocks to the plurality of circuit protection modules with a plurality of conductive bars passing through the panel enclosure, each of the conductive bars including a generally straight portion passing from the rear of the panel to the front of the panel.

DETAILED DESCRIPTION

Figure 1:
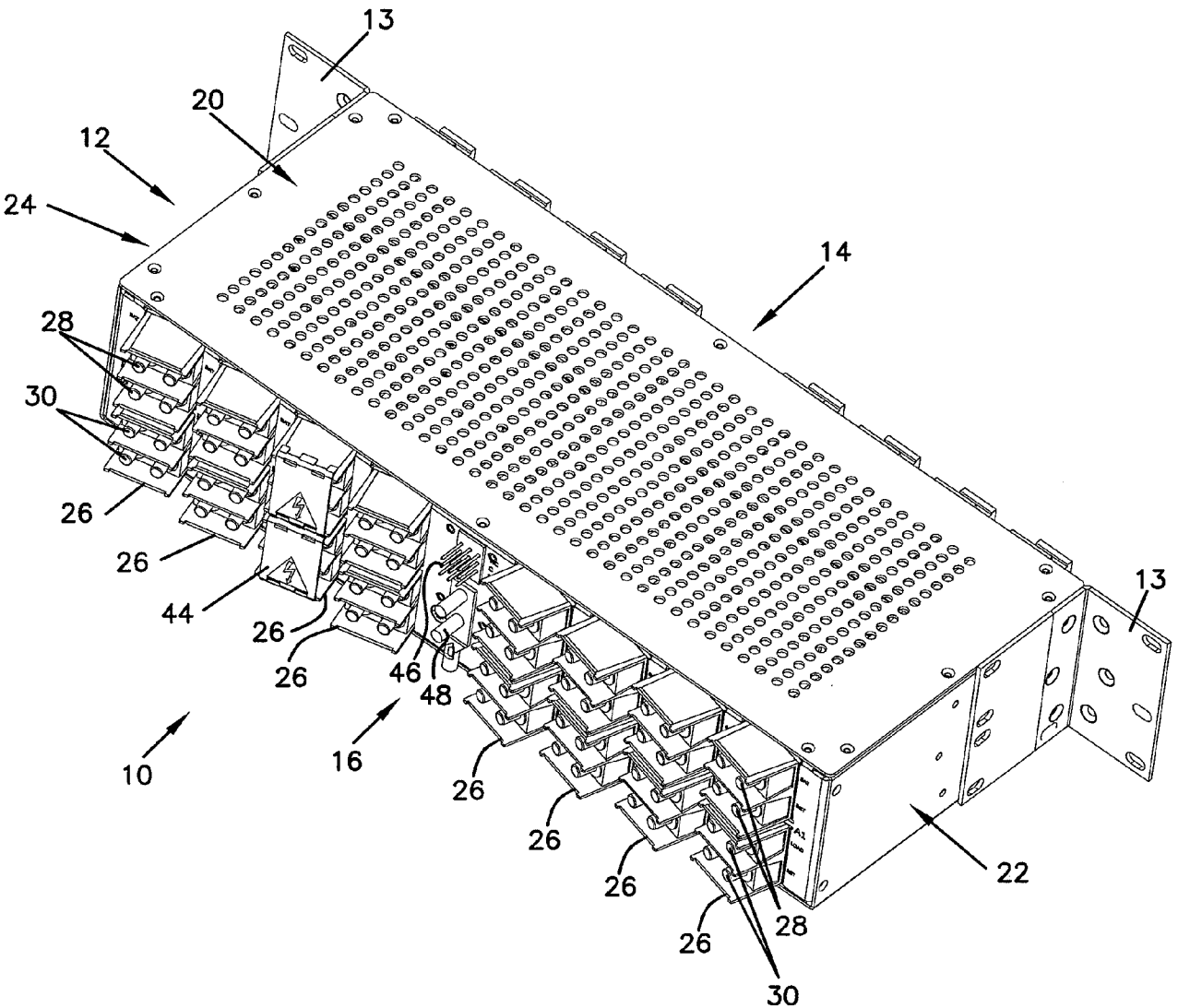
FIG. 1 is a top rear perspective view of a power distribution panel, according to a possible embodiment of the present disclosure.
Figure 2:
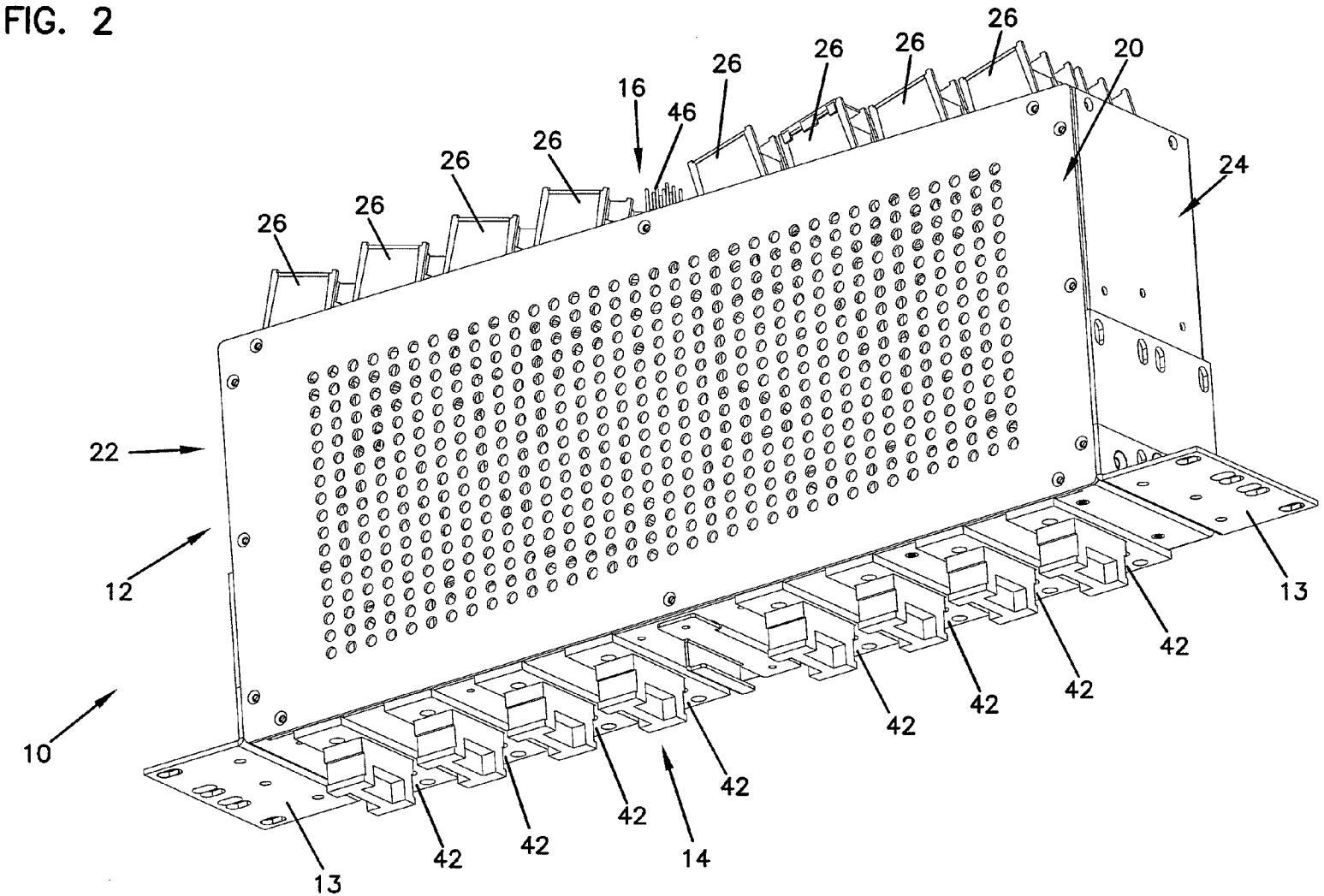
FIG. 2 is a top front perspective view of the power distribution panel of FIG. 1.
Figure 3:
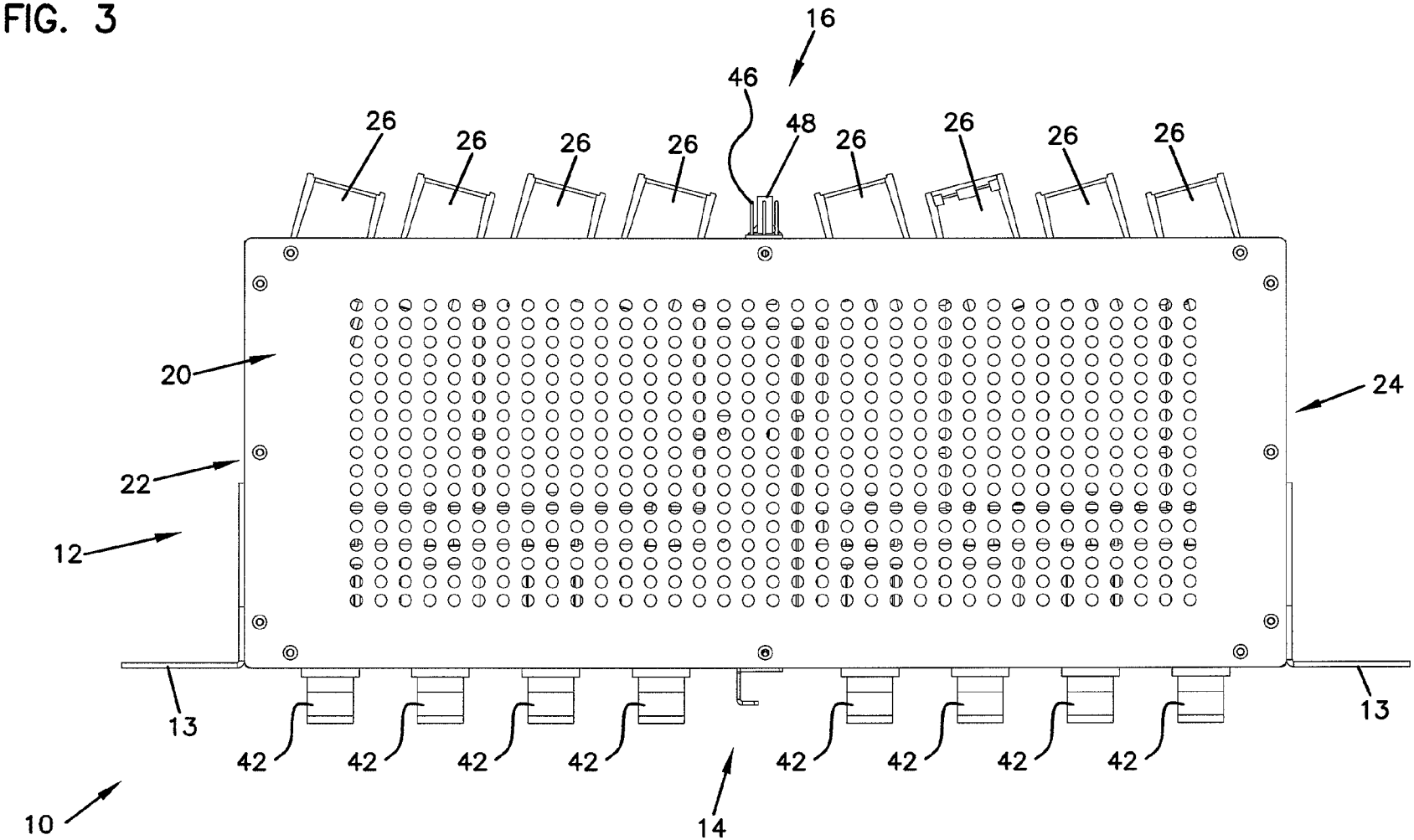
FIG. 3 is a top plan view of the power distribution panel of FIG. 1.

In general, a power distribution panel is disclosed. The power distribution panel, as explained in further detail below, includes angled connection blocks to allow convenient connection of power and load wiring to the power distribution panel. Further, the power distribution panel has an internal power bus arrangement allowing straight through connection of conductive bars, rather than tangled wiring passing through the panel, and around existing circuitry within the panel.

Now referring to FIGS. 1-9, details regarding the structural features and assembly of a power panel 10 are discussed, in conjunction with a possible embodiment of the present disclosure. The panel 10 generally includes a panel enclosure 12 which has a front face 14, a rear face 16, and an interior area 18. The panel enclosure 12 also includes a top side 20, bottom side (not shown), and left and right sides 22, 24, respectively. The panel enclosure 12 is preferably sized to fit into a telecommunications rack, and is generally made from metal and/or plastic components. The power panel 10, in general, contains circuitry necessary for monitoring and regulating power distribution and circuit protection (not shown), which are typically mounted within the interior area 18 of the enclosure 12.

Mounting brackets 13 connect to the left and right sides 22, 24 of the enclosure. The mounting brackets 13 are generally L-shaped and include a portion generally parallel with the front face 14 of the enclosure 12. The mounting brackets 13 provide a structure for physical attachment of the panel 10 to a telecommunications rack (not shown).

Connection blocks 26 are located on the rear face 16 of the panel, and each includes input connection 28 and output connection 30. Each of the connection blocks 26 are mounted at an angle with respect to the rear face 16 of the panel, and extend a common distance from the rear face of the panel. The angle of the connection blocks 26 is sufficient to allow access to a side of the connection block that is nearest one of the left and right sides, to allow connection of load or supply voltage cables to the connection blocks. In various embodiments the specific angle of the connection blocks will vary, depending upon the spacing and height of the connection blocks.

In the embodiment shown, a total of sixteen angled connection blocks are mounted to the rear face 16 of the panel 10, with eight of the angled connection blocks located nearest to and angled toward the left side 22, and eight of the angled connection blocks located nearest to and angled toward the right side 24. By angled toward, it is intended that a side of the connection block is exposed toward that same side of the panel, to allow connection of a cable to the connection block, such that the cable extends toward and into the side of the connection block.

Figures 8, 9:
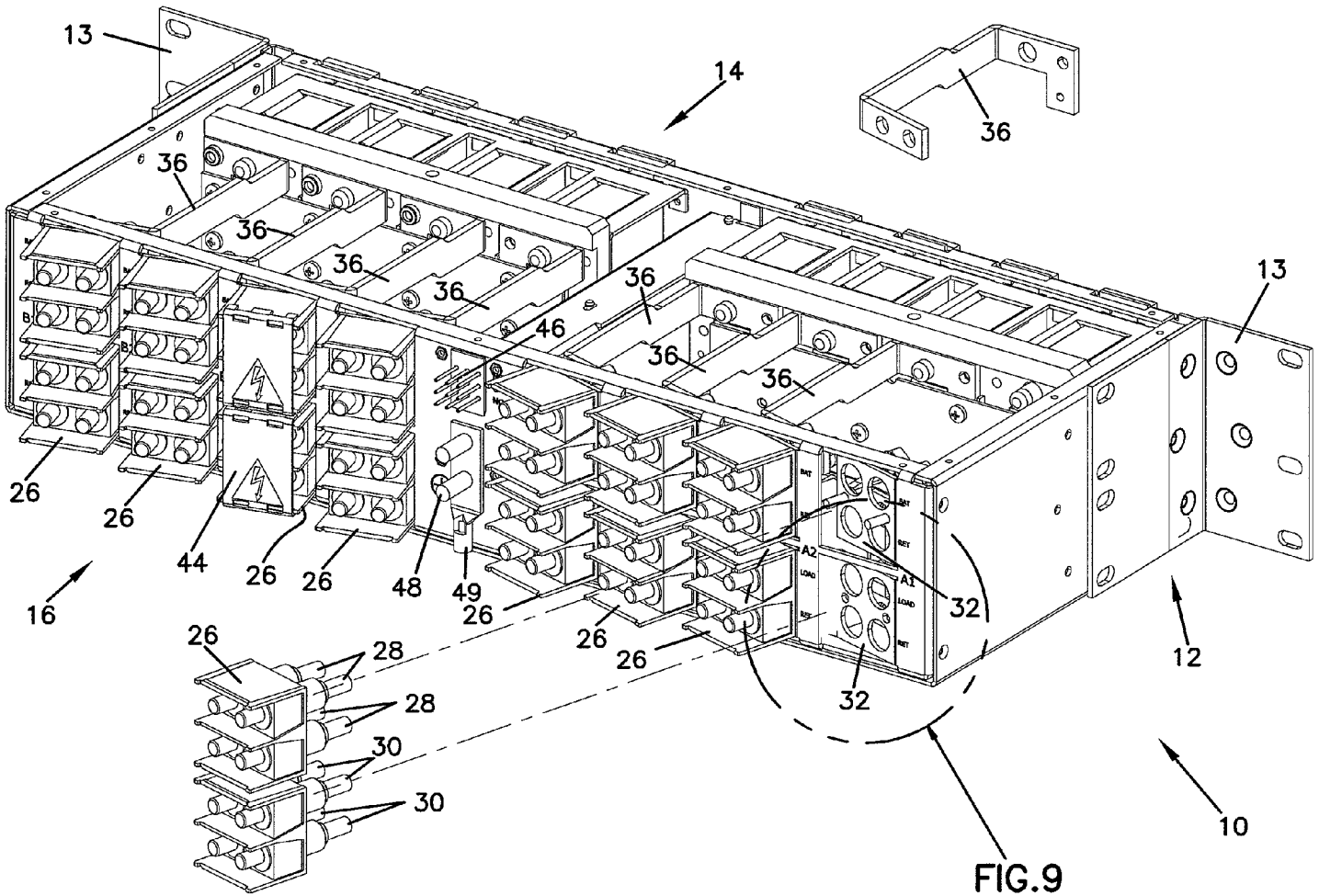
FIG. 8 is a rear perspective view of the power distribution panel of FIG. 1, illustrating mounting of a connection block and power distribution bus.
FIG. 9 is a close-up perspective view of a connection block mounting location on a rear of the power distribution panel of FIG. 1.
Figure 9:
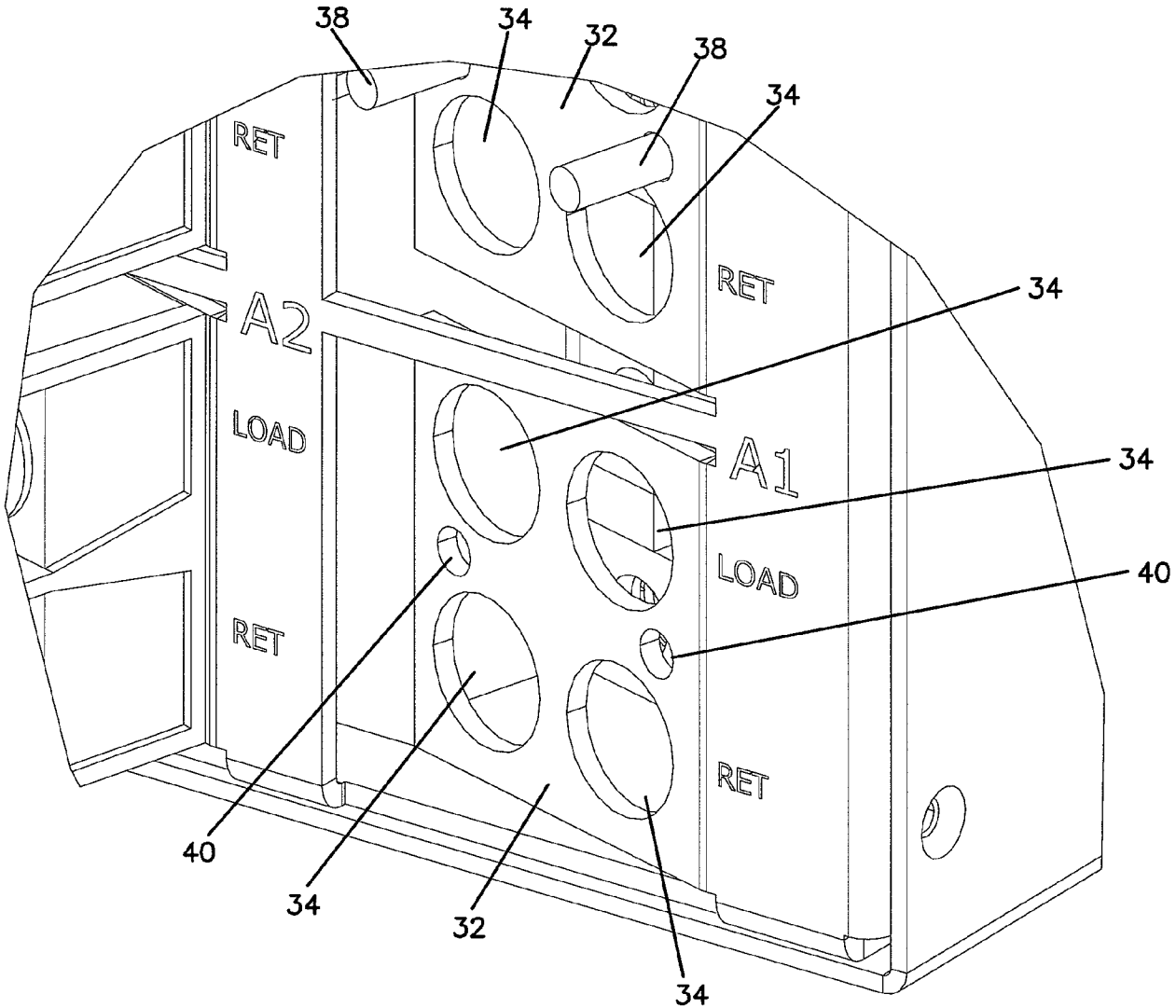

In the embodiment shown, the connection blocks 26 are generally rectangular, and form the angled arrangement by way of mounting to tabs 32 cut into the rear face 16 of the enclosure 12. Each of the tabs 32, best seen in FIGS. 8-9, is angled inwardly from the rear face 16, to form a stepped connection location pattern. The tabs 32 include openings 34 allowing connection of the input and output connections to conductive bars 36 within the enclosure 12. The tabs 32 also include screws 38 and screw receiving locations 40 that are used for mounting connection blocks 26, which have complementary mounting features thereon (not shown). Other mounting arrangements for the connection blocks are possible as well.

In further embodiments, the connection blocks 26 themselves can include a formed, angled structure, and are mounted at mounting locations that are generally parallel to the overall linear rear face 16. Other mounting arrangements for the connection blocks exist as well.

The input connections 28 and output connections 30 are preferably lug-type connections capable of receiving a screw-down connection of a cable. In the embodiment shown, the input connections 28 and output connections 30 are arranged on each connection block 26 such that the input connections reside above the output connections in a generally linear, symmetrical arrangement. In this embodiment, an equal number of input and output connections exist on each connection block. In further embodiments, the input and output connections can be arranged or numbered differently (e.g. by grouping the input connections on one connection block and output connections on a different connection block), while maintaining the angled arrangement of the connection blocks and resulting stepped cable connectivity.

Within the interior area 18 of the panel 10, conductive bars 36 connect a portion of the input and output connections 28, 30 protruding through the rear of the connection blocks 26 to circuit protection modules 42 at an opposite side of the enclosure. The conductive bars 36 can be formed from bar stock or another conductive material, and include at least a portion that passes generally straight through the interior area 18 of the enclosure 12. In the embodiment shown, a pair of conductive bars 36 connect between each conductive block 26 and circuit protection module 42, with one conductive bar connecting from the input connections 28, straight through the interior area 18 and to a first connection of the circuit protection module, and a second conductive bar connecting from a second connection of the same circuit protection module, straight through the interior area, and back to the output connections 30 of the same connection block. The conductive bars 36 can be bolted or otherwise fastened to the input and output connections 28, 30, and allow removable insertion of a connector of the circuit protection modules 42, as described further below.

Optionally each of the connection blocks 26 can be protected by a cover 44 (such as the example cover shown in FIG. 1). The cover 44 protects users from contacting a circuit and inadvertently causing a short circuit. In the embodiment shown, the cover 44 blocks access to a front side of the connection block, while allowing wired connections to access the input connections 28 and output connections 30 of the connection blocks 26 from the side of the block.

In certain embodiments of the panel 10, additional connection points can be included on the rear 16 of the enclosure 12 as well. For example, in the embodiment shown, a plurality of electrical pins 46 provide a communicative connection to circuitry within the panel to indicate alarm states of the panel (e.g. when a circuit breaker or fuse of one of the circuit protection modules 42 has been tripped, or if another electrical issue is detected within the panel. A plurality of grounding connections 48 can be located directly on the panel as well, and can provide connection point for a grounding connection 49 associated with the panel.

On the front face 14 of the panel 10, a plurality of circuit protection modules 42 provide circuit protection (voltage and/or current regulation) for load devices connected to the panel at the connection blocks 26. The circuit protection modules 42 are removably inserted into the enclosure 12. In various embodiments, the circuit protection modules 42 can incorporate fuses or circuit breakers, as well as alarm circuitry used to notify a user or maintenance personnel of a tripped circuit event. The circuit protection modules 42 can be removably mounted within the enclosure 12, including, for example, via a bullet-nosed connection 43 to a bus, such as can be formed by the conductive bars 36.

Cover plates 50 can block the openings into which the circuit protection modules 42 are placed, in case no circuit protection module is in use for that circuit. The cover plates 50 can be punch-out type plates formed in the front side 14 of the enclosure 12, or can be removable plates formed separately from the panel and attached thereto.

Figure 7:
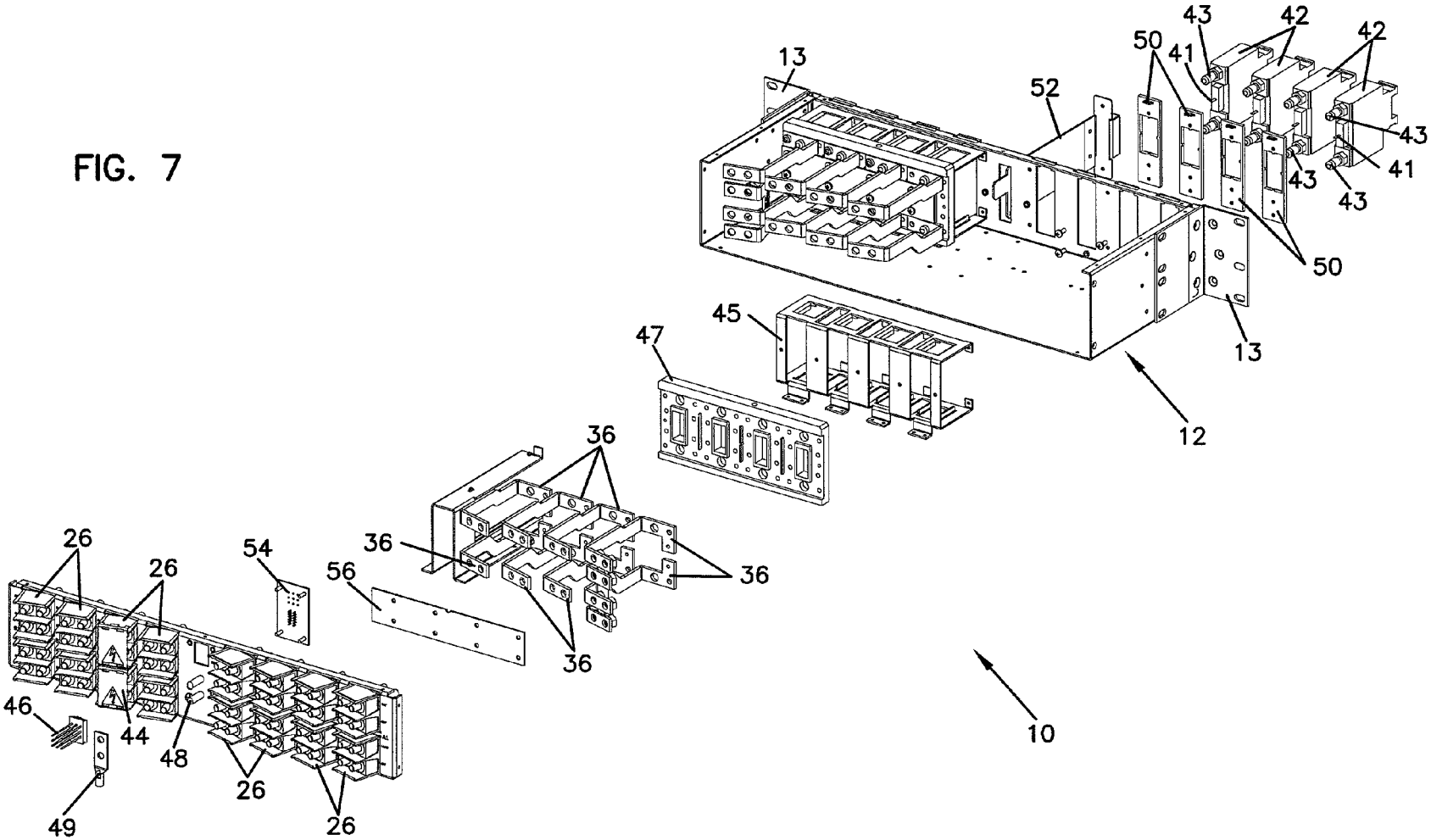
FIG. 7 is an exploded perspective view of the power distribution panel of FIG. 1.

As seen most clearly in FIGS. 7-8, the circuit protection modules 42 are held within the interior area 18 of the enclosure 12 by a mounting frame 45, and pass through a base plate 47 before connection to the conductive bars 36. The mounting frame 45 guides insertion of the circuit protection modules 42 into the enclosure 12, and support mounting of the base plate 47 within the enclosure as well. The base plate 47 is generally non-conductive, and includes openings for allowing connection of circuitry to auxiliary connections 41 on the circuit protection modules 42, which can provide alarming and other features. The base plate 47 isolates the grounding connections 48 from the other components in the panel.

In the embodiment shown, the conductive bars 36 are affixed to the base plate 47, and connect to the bullet-nosed connections 43 of the circuit protection modules 42 when such modules are inserted into the front face 14 of the panel. Other arrangements and connection types for the conductive bars can be possible as well, such that removable connection to the circuit protection modules is provided.

Also within the interior area 18, a circuit panel 52 can be inserted from the front face 14 of the panel 10, and can connect to a signal board 54, upon which the signal pins 46 are mounted at the rear face 16 of the panel. In the embodiment shown, a card edge connector (not shown) on the circuit panel 52 connects to the signal board 54 for transmitting signals to and from the pins 46. A circuit board 56 electrically connects to the auxiliary connections 41 of the circuit protection modules 42. The circuit board 56 provides a route by which alarm states of each of the circuit protection modules 42 can be communicated within the rest of the panel 10 (and externally to the panel). In the embodiment shown, two such circuit boards are used, one for each of left and right sides of the panel and each connecting to four sets of auxiliary connections 41 on a corresponding sets of four circuit protection modules 42. The circuit board 56 can then be arranged to connect to electrical pins, such as the pins 46. Other circuitry arrangements are possible as well.

In an example of possible use of the panel 10, service personnel can mount the panel to a telecommunications rack for use at a telecommunications distribution location. The service personnel route power source cables to the rear side of the panel 10, from the left and right sides. The power source cables can be connected to each of the input connections 28 that are in an angled, stepped arrangement (due to the angled, stepped nature of the communication blocks 26) along the rear of the panel. Load cables can also be routed to the panel 10 from the left and right sides, respectively, and connected to each of the output connections 30 of the angled, stepped connection blocks 26. The service personnel can then place a cover 44 over the connection block 26 to prevent accidental contact with one or both of the input and output connections 28, 30.

As power is distributed to a load connected to the load cables, the circuit protection modules 42 or other circuitry within the panel 10 can detect a current or voltage that is above or below an expected value and take action accordingly. For example, an overcurrent event can blow a fuse or trip a circuit breaker that is included in a circuit protection module. The service personnel can replace the fuse or reset the circuit breaker, or can replace the entire circuit protection module, re-enabling power distribution via the connection block 26 and associated circuit protection module connected to that load.

In certain embodiments, the panel 10 is arranged to receive and distribute about 125 amps per circuit included in the panel. In further embodiments, additional or less current can be passed through the panel. In one example embodiment, 180 amps can be provided over all channels at 36 VDC and 135 amps can be provided over all channels at 48 VDC (to a total worst-case load current of 225 amps during surge events at 36 VDC). In these various embodiments, circuit breaker and/or fuse elements are selected to trigger a short circuit upon detection of an overcurrent event that is greater than a predetermined threshold. Other amperage and voltage ratings can be provided as well.

Figure 4:
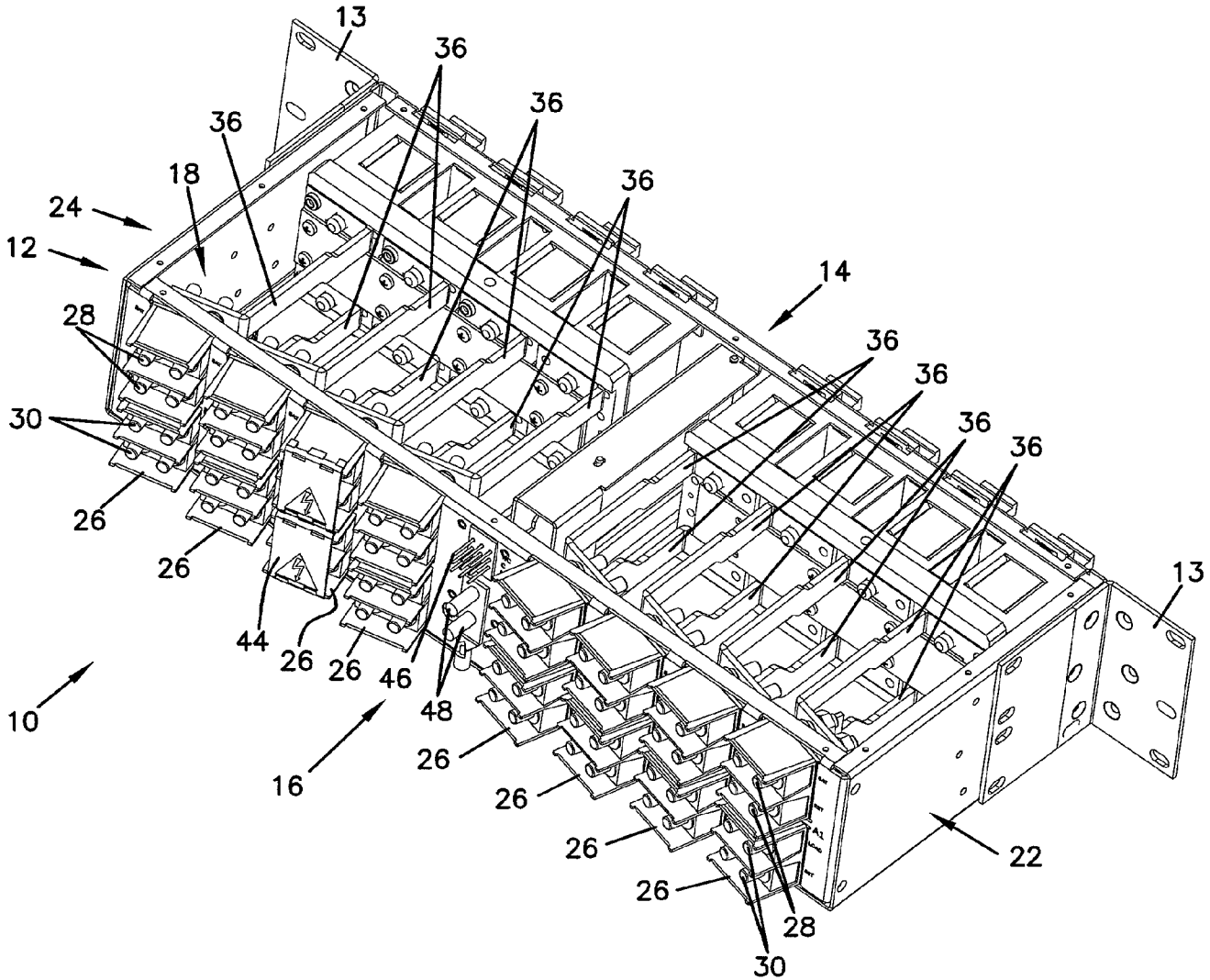
FIG. 4 is a top rear perspective view of the power distribution panel of FIG. 1, with a top cover removed.
Figure 5:
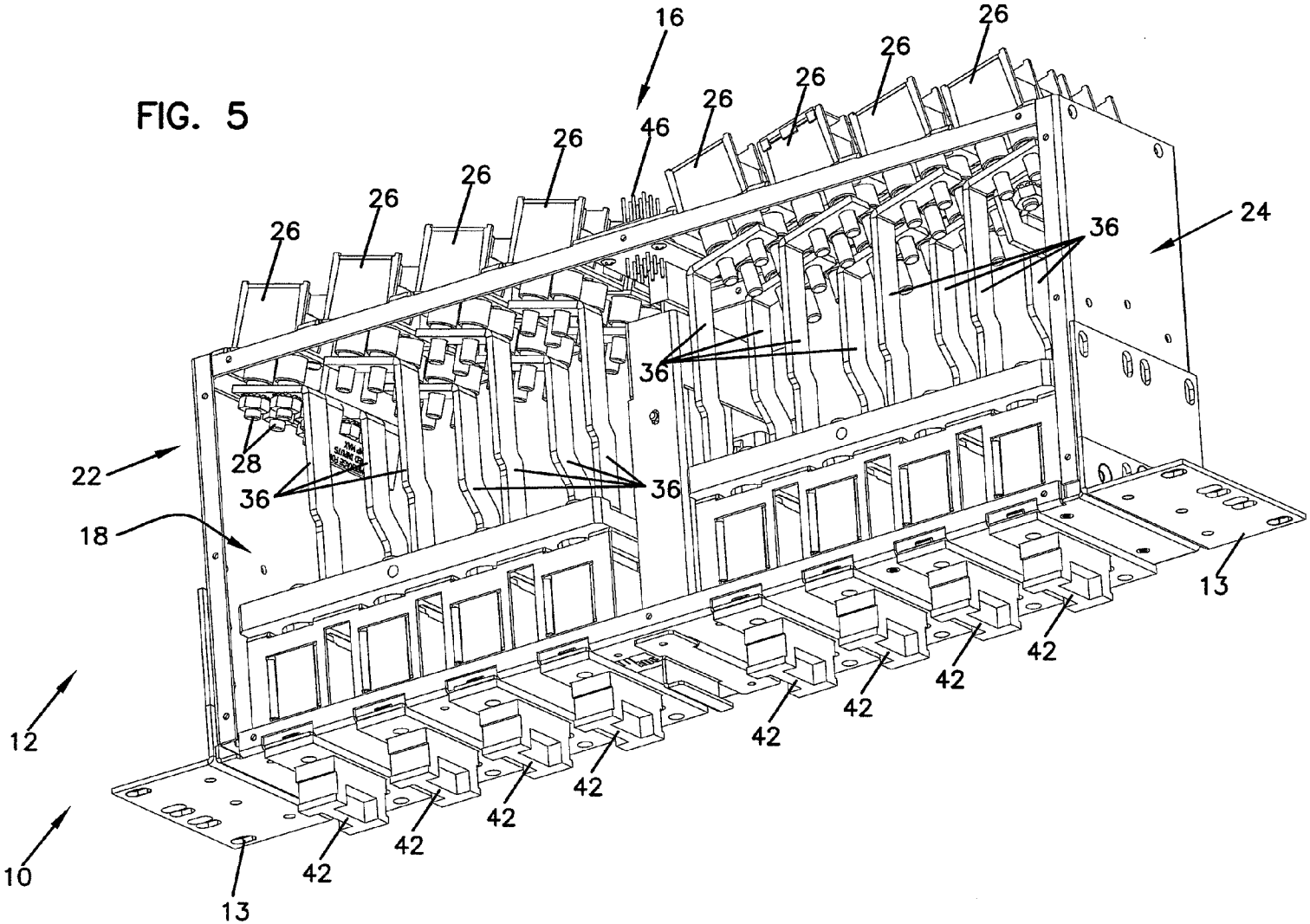
FIG. 5 is a top front perspective view of the power distribution panel of FIG. 1, with the top cover removed.
Figure 6:
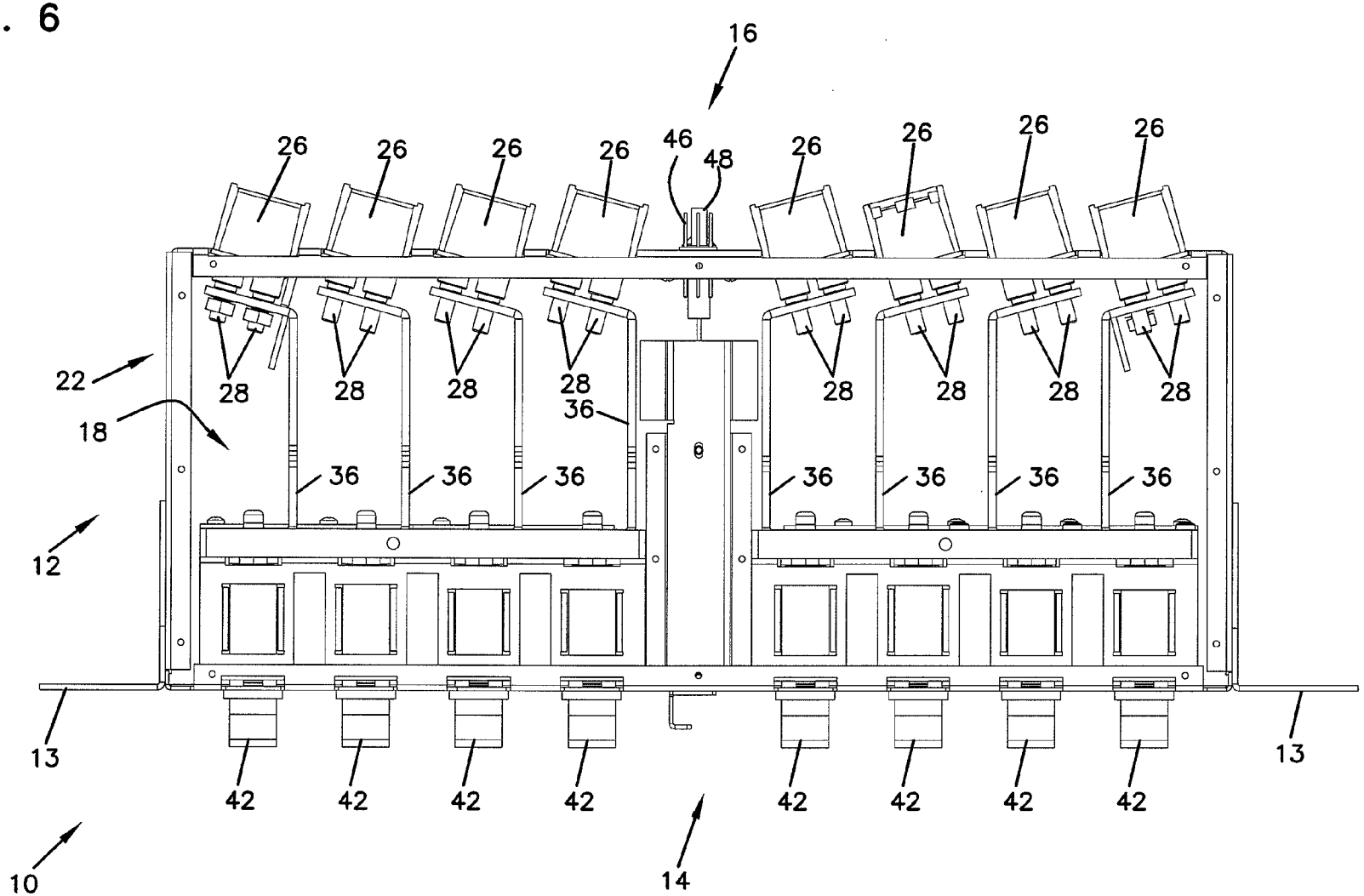
FIG. 6 is a top cross-sectional view of the power distribution panel of FIG. 1.

When the service personnel require access to the interior of the panel 10 (e.g. for access to the circuitry within the panel) a top cover can be removed from the panel, as shown in FIGS. 4-6. Due to the generally linear nature of the conductive bars 36, the service personnel can easily access components within the panel, and can address circuit load and connectivity issues with respect to each module independently. Other advantages of the panel 10 exist as well, as previously described.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A power distribution panel comprising:

a panel enclosure having a front face, a rear face, and an interior;

a first plurality of connection blocks, each of the first plurality of connection blocks located on the rear face of the panel enclosure and oriented at a first common angle relative to the rear face of the panel enclosure;

a second plurality of connection blocks, each of the second plurality of connection blocks located on the rear face of the panel enclosure and oriented at a second common angle relative to the rear face of the panel enclosure;

a plurality of circuit protection modules located on the front face of the panel enclosure; and a plurality of conductive bars passing through the enclosure and connecting the first and second pluralities of connection blocks to one of the plurality of circuit protection modules, each of the conductive bars including a generally straight portion passing from the front of the panel to the rear of the panel.

2. The power distribution panel of claim 1, wherein the first plurality of connection blocks extend a common distance from the rear of the panel.

3. The power distribution panel of claim 1, wherein the first common angle is oriented toward a first side of the panel enclosure and the second common angle is oriented toward a second side of the panel enclosure.

4. The power distribution panel of claim 1, wherein a pair of conductive bars connects each circuit protection module to one of the first and second pluralities of connection blocks.

5. The power distribution panel of claim 1, wherein the plurality of conductive bars are made from bar stock.

6. The power distribution panel of claim 1, wherein each of the first and second pluralities of connection blocks includes a power input connection and a power output connection.

7. The power distribution panel of claim 6, wherein the power input connection and the power output connection are vertically disposed on each of the first and second pluralities of connection blocks.

8. The power distribution panel of claim 1, wherein the rear face includes a plurality of angled mounting locations arranged to receive the first and second pluralities of connection blocks.

9. The power distribution panel of claim 8, wherein the angled mounting locations are formed from the rear face of the panel enclosure.

10. The power distribution panel of claim 1, wherein the plurality of circuit protection modules includes fuse modules.

11. The power distribution panel of claim 1, wherein the plurality of circuit protection modules includes circuit breaker modules.

12. A power distribution panel comprising:

a panel enclosure having a front face, a rear face, and an interior;

a first plurality of connection blocks, each of the first plurality of connection blocks located on the rear face of the panel enclosure and having input and output connections oriented at a first common angle relative to the rear face of the panel enclosure;

a second plurality of connection blocks, each of the second plurality of connection blocks located on the rear face of the panel enclosure and having input and output connections oriented at a second common angle relative to the rear face of the panel enclosure;

a plurality of circuit protection modules located on the front face of the panel enclosure, each of the circuit protection modules associated with one of the first or second plurality of connection blocks; and a plurality of conductive bars passing through the enclosure and connecting the first and second pluralities of connection blocks to the associated one of the plurality of circuit protection modules, each of the conductive bars including a straight portion passing from the front of the panel to the rear of the panel and connecting between one of the plurality of circuit protection modules and one of the first and second pluralities of connection blocks.

13. The power distribution panel of claim 12, wherein the first plurality of connection blocks extend a common distance from the rear face of the panel.

14. The power distribution panel of claim 12, wherein the first common angle is oriented toward a first side of the panel enclosure and the second common angle is oriented toward a second side of the panel enclosure.

15. The power distribution panel of claim 12, wherein a pair of conductive bars connects each circuit protection module to one of the first and second pluralities of connection blocks.

16. The power distribution panel of claim 12, wherein the rear face includes a plurality of angled mounting locations arranged to receive the first and second pluralities of connection blocks.

17. A method of assembling a power distribution panel, the method comprising:

attaching a first plurality of connection blocks to a rear face of a panel enclosure at a first plurality of angled mounting locations having a first common angle relative to the rear face of the panel enclosure;

attaching a second plurality of connection blocks to the rear face of the panel enclosure at a first plurality of angled mounting locations having a second common angle relative to the rear face of the panel enclosure;

locating a plurality of circuit protection modules at a front face of the panel enclosure; and connecting the first and second pluralities of connection blocks to the plurality of circuit protection modules with a plurality of conductive bars passing through the panel enclosure, each of the conductive bars including a generally straight portion passing from the rear of the panel to the front of the panel.

18. The method of claim 17, further comprising connecting a power supply to one or more input connections located on the first and second pluralities of connection blocks.

19. The method of claim 17, further comprising connecting a load to one or more output connections located on the first and second pluralities of connection blocks.

20. The method of claim 17, wherein the first common angle is oriented toward a first side of the panel enclosure and the second common angle is oriented toward a second side of the panel enclosure.

21. The method of claim 17, wherein the first and second pluralities of connection blocks extend a common distance from the rear of the panel.

* * * * *